United States Patent [19]

Klügl et al.

[11] 4,167,798

[45] Sep. 18, 1979

[54] CLEANING APPARATUS FOR TEXTILES

[76] Inventors: Gerhard Klügl, Drosselstrasse 10, 8051 Langenbach; Klaus Jährling, Rathfeldstrasse 1, 8011 Anzing, both of Fed. Rep. of Germany

[21] Appl. No.: 836,243

[22] Filed: Sep. 23, 1977

[30] Foreign Application Priority Data

Sep. 24, 1976 [DE] Fed. Rep. of Germany ..... 2642912

[51] Int. Cl.[2] ..... A47L 7/00; A47L 11/34

[52] U.S. Cl. ..... 15/320; 15/321; 15/334; 15/353; 55/337

[58] Field of Search ..... 15/320, 321, 331, 334, 15/353; 55/337

[56] References Cited

U.S. PATENT DOCUMENTS

| | | | |
|---|---|---|---|
| 1,405,399 | 2/1922 | Donaldson | 55/337 |
| 2,622,254 | 12/1952 | Mendelson | 15/334 X |
| 2,910,720 | 11/1959 | Smith | 15/320 |
| 2,972,769 | 2/1961 | Keating et al. | 15/353 |
| 3,148,400 | 9/1964 | Wörwag | 15/337 X |
| 3,624,861 | 12/1971 | Freiheit | 15/320 |
| 3,633,240 | 1/1972 | Crenner et al. | 15/321 |
| 3,676,889 | 7/1972 | Edlin | 15/320 |
| 3,877,902 | 4/1975 | Eriksson et al. | 55/337 |

*Primary Examiner*—Christopher K. Moore
*Attorney, Agent, or Firm*—Cushman, Darby & Cushman

[57] ABSTRACT

A cleaning apparatus for carpets, carpet bases, upholstery and the like has a blower for producing compressed air and suction air, a compressed air main pipe, a foam producing device connected to the main pipe and a nozzle for depositing the foam on the surface to be cleaned, a suction nozzle for drawing up the foam and dirt, a separator including a filter unit and a dirt chamber, a closable opening in the compressed air main pipe and an additional cleaning device having a supply hose and a connection piece for insertion into the closable opening.

11 Claims, 8 Drawing Figures

FIG. 3
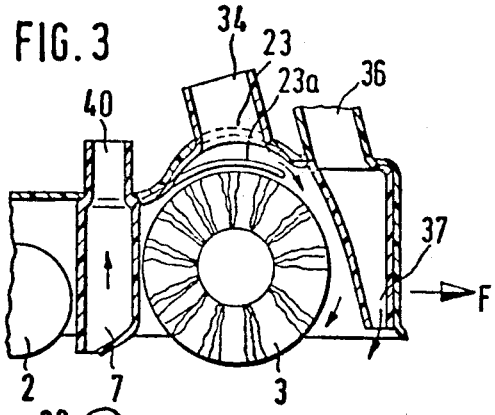
FIG. 4
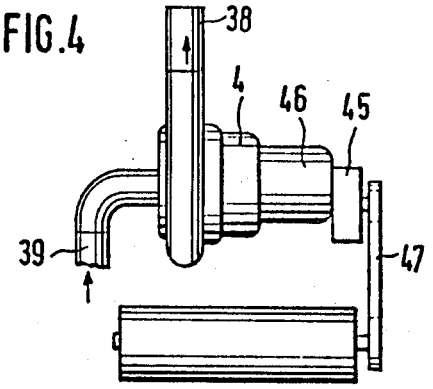
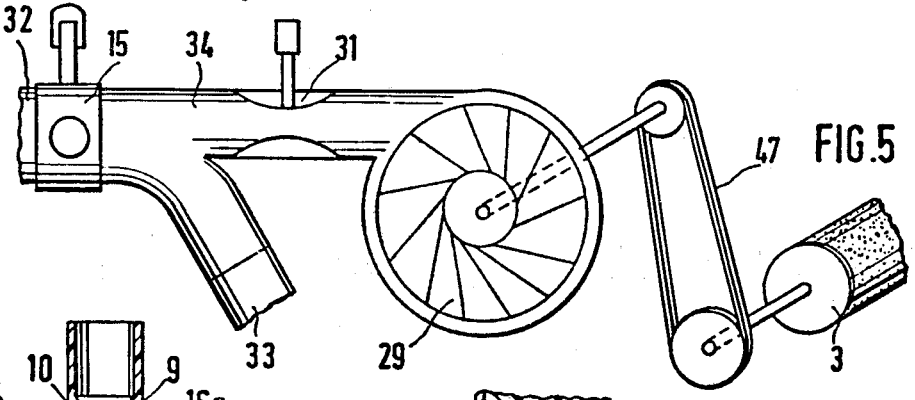
FIG. 5
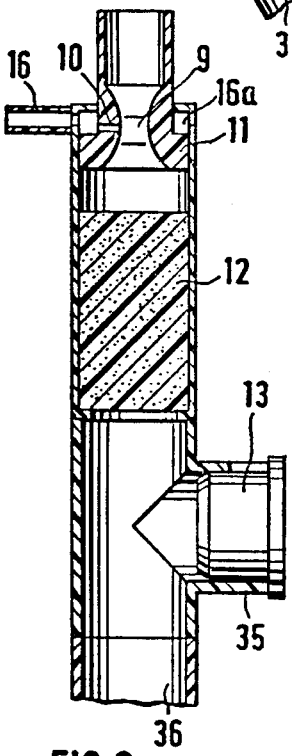
FIG. 6
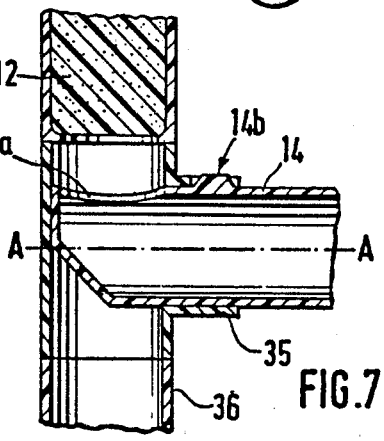
FIG. 7
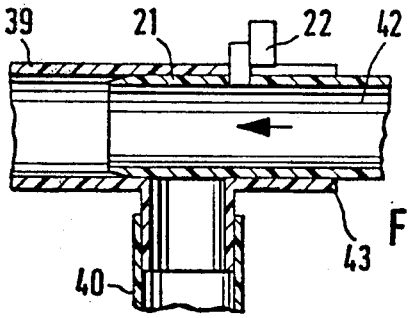
FIG. 8

CLEANING APPARATUS FOR TEXTILES

The invention relates to a cleaning apparatus movable on the ground for textiles, in particular a universal apparatus for carpets, carpet bases, upholstery and the like having a device for producing cleaning foam and for its application onto the surface to be cleaned and having a suction blower for drawing off cleaning foam and/or dirt from the surface to be cleaned whereby the air at the pressure side of the suction blower is led via a compressed air main pipe to the apparatus for the producing of the cleaning foam.

Such air cleaning apparatus is known from U.S. Pat. Nos. 2,910,720 and 3,755,850. With this known cleaning apparatus movable on the ground a large tank for cleaning liquids such as soap solution is provided which is partly filled with the cleaning liquid and has in its upper part an air cushion. For the producing of foam, air removed at the pressure side of the suction blower is blown into the tank below the level of the cleaning liquid so that the free space remaining above the level of the cleaning liquid is filled with foam. Under the pressure of the compressed air blown in, the foam at the upper side of the tank is pressed into a supply pipe for the deposit of foam at floor level in front of a brush roller. On the rear side of the brush roller the foam is drawn off into a dirt container on which the suction connection piece of the suction blower is fixed. For the cleaning of upholstery or the like there may be connected to a second connection piece from the upper side of the tank a supply hose to an additional apparatus such as a hand brush whilst the supply pipe for the floor level foam deposit is closed. Via a connection pipe which passes through the wall of the dirt container there may be connected if necessary a suction hose for the drawing off of the cleaning foam deposited onto the upholstery.

In the dirt container of the known apparatus a defoaming agent or foam remover must be provided so that the foam drawn off does not stop up the dirt container after only a very short working period and overflow into the suction blower. Particles of this foam remover however whirl around in the intensive air current in the dirt container and thus reach, via the suction blower, the tank for the cleaning liquid. Since a few traces of the foam remover will suffice completely to prevent formation of the foam, with known types of cleaning apparatus, problem-free operation of the device is very much in doubt.

This drawback may indeed be obviated if necessary in that extensive separating and filtering measures against the overflowing of foam removing particles into the suction blower may be provided which, however, further increase the constructional expenditure and the size of the apparatus which is already very large. The drawback where the control of the formation of foam with the known apparatus is not effected is even more serious because no cleaning foam of optimum consistency can be prepared. All the compressed air of the suction blower operating at high output is introduced to the tank and used for the formation of foam so that comparatively wet foam results which is pressed through a mouth of narrow cross-section into the supply pipe for the foam deposit at floor level. The deposit of foam and the consistency of the foam may, if necessary, be influenced by the water content of the soap solution which however requires expensive experiment in the respective individual case and the consistency of the foam is insufficiently influenced. Even, however, when in an individual case satisfactory foam is deposited for floor use, with the connection of the hand apparatus, the foam emerging there is certainly almost unusable as in the considerably longer supply hose to the hand apparatus considerably greater flow losses occur, and therefore upon switching over from the floor deposit to a deposit by means of the hand apparatus the foam emerges therefrom with practically unusable consistency even when the consistency of the foam emerging previously at the floor level was satisfactory.

The object of the invention therefore is to provide a cleaning apparatus and, in particular, a universal apparatus of the above-mentioned type which with simple, space saving and cheap construction can reliably supply foam of the desired optimum consistency.

This object is obtained according to the invention by the characterizing features of claim 1.

By the insertion of a separator for impurities in particular the foam removing particles between the suction blower and the foam producing place the result is achieved that the foam production is not brought into question by the supply of traces of foam remover. Thereby a reliably operating cleaning apparatus may be provided in which compressed air from the suction blower is used for foam production. Moreover, by means of a control member an adjustable quantity of excess air for the production of foam can be drawn off as the pressure and output of the suction blower are too high for the normal requirements of the production of foam. This excess air however in one embodiment of the invention according to the features of claims 3 to 6 may be made use of for driving the apparatus so that even the energy content of the compressed air from the suction blower not required for the production of foam is utilised elsewhere.

By the production of foam in a nozzle with subsequent drying of foam, as is known for example from German Patent Specification laid open to inspection No. 1,207,564 or 1,208,458, the production of foam requires minimal constructional and space expenditure so that the apparatus for the production of the cleaning foam in the manner desired for a cheap domestic apparatus requires hardly any cost and no additional space.

By the production of foam in the compressed air pipe the connections for a hand apparatus in the manner described herein are furthermore substantially simplified. With the use of a hand apparatus the high supply output of the suction blower renders possible a considerable reduction of the excess air if necessary to zero so that the whole supply output of the suction blower is available for the production of foam and in particular for the supply of foam to the pipe to the hand apparatus which may be several meters long. Thereby in any operating manner foam of optimum consistency can be simply produced which as is known is of extraordinary importance for a satisfactory cleaning.

The construction of the separator with subsequently connected filter as described herein ensures in the narrowest possible space a reliable separation of impurities, in particular foam removing particles from the drawn up foam whereby first of all like a cyclone separator a centrifuging out of the dirt particles is effected, and the relatively clean radially inner portions of the flow are, after several revolutions, each effecting further cleaning to an easily exchangeable filter which holds back the last impurities. The space requirement for the cleaning apparatus results substantially from the space requirement of the blower on the one hand and the space requirement for the separator with filter unit and dirt container lying thereunder on the other hand whereby additionally to these units there are provided only pipes and a brush roller which require hardly any additional space and demand only small constructional expenditure. The supply container for the cleaning liquid may, in the manner known for example from German Gebrauchsmuster Nos. 7,441,369 or 7,502,155, be provided on guide rods so that it does not take up any additional space.

Cleaning apparatus of the construction known from German Gebrauchsmuster Nos. 7,441,369 and 7,502,155 serve indeed only for the cleaning of carpets by deposits of foam at floor level but correspond otherwise likewise to the main idea of claim 1. In apparatus according to the U.S. Pat. Nos. 2,910,720 or 3,755,850, explained at the beginning, a foam depositing takes place first of all without drawing off, whilst only in the next working procedure alone does the drawing off take place. This is disadvantageous as the foam combined with dirt can penetrate deeper into the fabric and is subsequently difficult to remove. By the use according to the invention of a separator for the impurities taken along by the suction air between the pressure side of the suction blower and the foam producing place in contradistinction thereto work can be done to a certain extent in a closed air circuit in which the air just drawn in cleaned is immediately available again for the production of foam so that the foam can be deposited uninterruptedly and drawn off without disturbances occurring in the production of foam. On the contrary, the production of foam by means of the control member provided according to the invention is adaptable optimally to the particular conditions of use.

Further details, features and advantages of the invention result from the following description of embodiments with reference to the drawings.

FIG. 3 shows a detail from FIG. 2 in a modified embodiment;

FIG. 4 shows a diagrammatical representation of the roller drive in the embodiment according to FIG. 2;

FIG. 5 shows a diagrammatical representation of a modified embodiment for the roller drive;

FIG. 6 shows a sectional representation of the area of the production of foam with the closed connection piece for the connection of the supply hose to the hand apparatus;

FIG. 7 shows a representation corresponding to the lower area of FIG. 6 with the supply hose connected for the hand apparatus and FIG. 8 shows a sectional representation of the connection for the suction hose of the hand apparatus.

Figure 1:
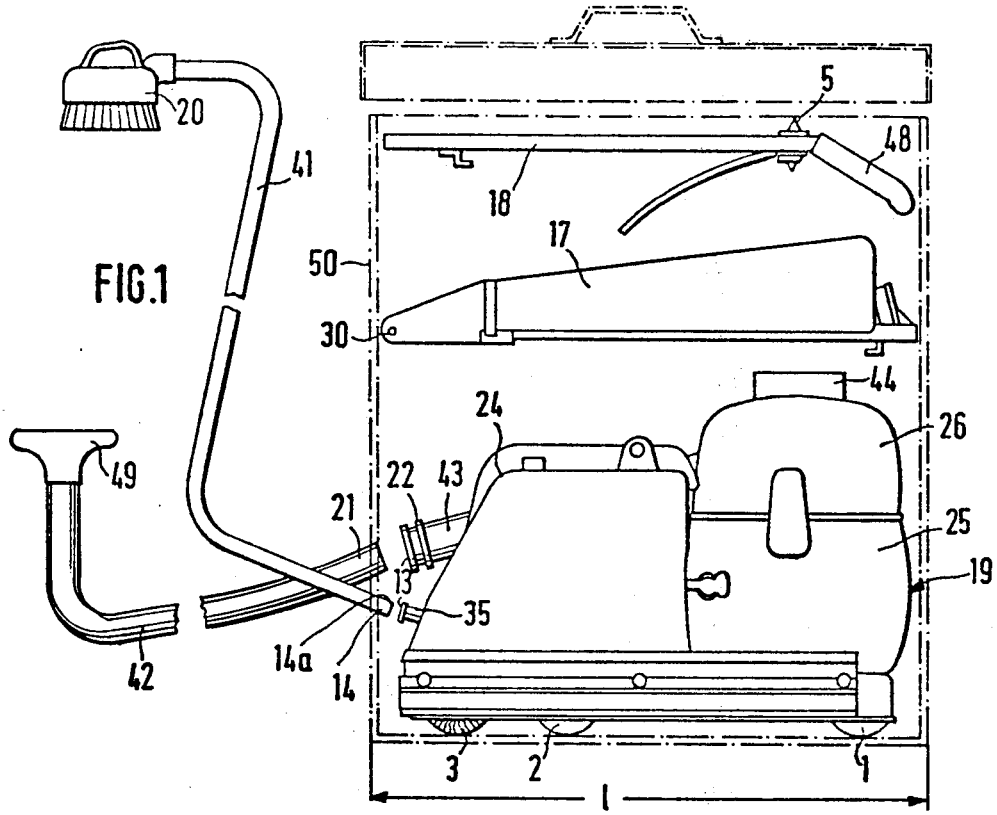
FIG. 1 shows a side view of the cleaning apparatus according to the invention in its transporting position.
Figure 2:
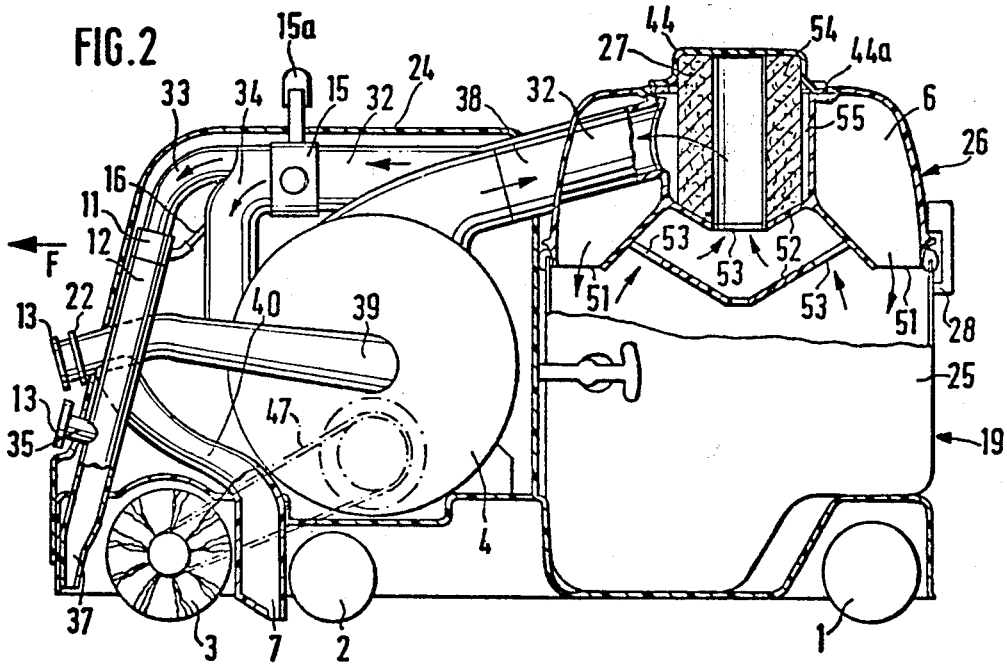
FIG. 2 shows a longitudinal section through the floor unit.

The basic construction of the cleaning apparatus follows in particular from FIGS. 1 and 2. The floor unit of the cleaning apparatus indicated in its entirety with the reference 19 has front and rear runner rollers 1 and 2 whereby the front runner roller 2 serves at the same time as a squeezing roller for the supply of foam to a suction nozzle 7. Between a foam depositing nozzle 37 and the suction nozzle 7 there is disposed a brush roller 3 which is rotationally driven by a belt drive 47 in the manner as can be seen from FIG. 4 or 5 described in more detail later. The front part of the floor unit 19 serves particularly for carrying suction blower 4 whilst the rear part serves for carrying a dirt container 25 and a separator 26.

As can be seen from FIG. 1 a guide rod 18 belongs to the floor unit above a supply container 17 which forms a rod underpart and which is hinged to the floor unit 19. The rod lower part forming the supply container 17 is connected articularly at 30, in a manner not further described to the right rear side of the floor unit 19 in the drawing and lengthened at its opposite side by the guide rod 18. In the region of the handle of the guide rod indicated with the reference 48 a valve 5 is provided with which the delivery of the cleaning liquid from the container 17 is controlled for example in the manner known from German Gebrauchsmuster No. 7,441,369.

The floor unit 19 with the container 17 and the guide rod 18 may be accommodated in a carrying case 50 as can be seen in FIG. 1. The dimensions may be so selected that the length of the case indicated with the reference 1 does not exceed 50 cm and the length of the floor unit 19 therefore amounts to only 40 to 45 cm. The remaining measurements follow from the almost true-to scale representation in FIG. 1 so that it can be seen that the cleaning apparatus according to the invention is constructed extraordinarily compact by and can be used as a small household apparatus.

In the case of the use as a universal apparatus suitable also for the cleaning of upholstery or the like there belongs to the floor unit 19 furthermore an additional apparatus 20 for example a hand brush which serves for the rubbing in of the foam applied via a supply hose 41 into the upholstery or other surfaces to be cleaned. The additional apparatus 20 could also be formed as a suction brush but it has been proved in practice advantageous to provide a suction head 49 separately so that with the additional apparatus 20 and the suction head 49 both can be used either successively or with two hands. For the connection of the supply hose 41 there is provided on the floor unit 19 in the manner to be explained later a closable opening 35, whilst the end 43 of a suction connection piece 39 serves for the connection of a suction hose 42 to the suction head 49.

The fundamental manner of working of the cleaning apparatus according to the invention can be seen in particular with reference to FIG. 2. In operation the suction blower driven from an electric motor 46 (see FIG. 4) works and sucks air from the suction connection piece 39. The end 43 of the suction connection pipe 39 is for the cleaning of carpets or carpet bases, closed by means of a closure 13 so that air is sucked via the suction nozzle 7. In the manner described in more detail further on foam is distributed in front of the brush roller by means of foam delivery nozzle 37 is worked into the floor by means of the brush roller 3 and is removed together with the dirt again from the carpet or the like by means of the suction nozzle 7. The dirt laden suction air passes through the suction blower 4 and reaches its pressure side via a pressure pipe 38 in the separator 26. If necessary the suction inlet of the suction blower 4 may of course be provided with a coarse filter in known manner in order to avoid too great a soiling of the suction blower 4.

In the separator 26 the air first of all reaches tangentially into an annular centrifuging chamber 6 in which a strong annular flow prevails so that the impurities are centrifuged out to the radial outer region of the centrifuge chamber 6. The whirling compressed air then passes into the dirt container 25 via an annular overflow opening 51 which lies radially outward in respect of the outer annular wall of the centrifuge chamber 6 whereby the portions of air rich in dirt move radially further outwards and downwards. On the radial inner side of the overflow opening 51 there are provided guide walls 52 with air passage openings 53 through which the air flies out of the dirt container 25 in the direction of the arrows drawn. Thereby the air arriving from the annular overflow opening 51 in to the dirt container 25 flows either to the region of the floor of the dirt container 25 so that dirt particles deposit in sufficient quantity or in a short air-flow path from the radial inner region of the overflow opening 51 with immediate guiding radially inwards through the air passage openings 53 so that on a short path there is fed to the air passage openings 53 only air from the clean radially inner region of the overflow opening 51. The further guides on the guide walls 52 according to the arrows shown serve for the additional obstruction of dirt particles. Foam remover is introduced into the dirt container 25 which liquifies immediately the foam introduced with the air.

Above the guide walls 52 there is mounted in the radial inner space of the centrifusion chamber 6 a filter unit 27. The filter unit 27 has in the manner demonstrated a cylindrical filter 54 which is covered on its upper side by a lid 44. The air arrives via a central air passage opening 53 in the manner illustrated into the inner space of the cylindrical filter 34, which is formed preferably as a so-called cartridge filter, passes through the filter walls and arrives into an outer annular space 55 from where the filtered clean compressed air overflows into the compressed air main pipe 32. The lid 44 is in the manner illustrated placed with an annular seal 44A on the opening in the wall of the centrifuge chamber 6 receiving the cylindrical filter 54 and in conventional manner, not shown in detail, is fixed by means of a rapid clamping closure. After releasing the rapid clamping closure the lid 44 may be taken off and together with the lid or immediately following it the cylindrical filter 54 is removed and replaced by another filter. The whole separator 26 with the centrifuge chamber 6 and the radially inner filter unit 27 serves as a lid of the dirt container 25 and is detachably connected to the dirt container 25 by means of a simple rapid closure 28 so that the inside of the dirt container 25 is rapidly accessible at any time.

In the region of the lid 44 or the beginning of the compressed air main pipe 32 an adjustable by-pass opening may be provided in a manner not shown in detail with which a part of the compressed air supplied from the suction blower 4 into the compressed air main pipe 32 may in case of need be let off into the surroundings. Such a letting off of a portion of the air into the surroundings may, as will be explained later, be advisable when floor cleaning operation is to be done for any reasons without driving of brush roller 3 or when, in working with the additional apparatus 20, a reduction of the pressure in the supply hose 41 for the supply of foam is to be achieved without thereby a driving of the brush roller 3 being effected.

The compressed air main pipe 32 leads the compressed air emerging from the filter unit 27 to the region of a control member 15 which divides the throughput in the compressed air main pipe 32 between a branch pipe 34 and a foam producing branch 33. The control member 15 is shown only diagrammatically in FIG. 2 as comprising a control handle 15A as the construction and the detailed manner of working are not constituent parts of the present invention. The actuation of the control member 15 by the control handle 15A will adjust the portion of compressed air from the compressed air main pipe 32 which is introduced into the branch pipe 34. Downstream of the branch point a further control member 31 may be provided either additionally to the control member 15 or instead of the control member 15 in the manner as can be seen in FIG. 5. For example, the cross-section of the flow in the branch pipe 34 may be closed or partly or fully released by an adjustable throttle or shutter. With the use of such a control member 31 alone the flow resistance and thus the cross-section of the branch pipe 34 is selected preferably such that with completely opened control member 31 a considerable portion of the compressed air from the compressed air main pipe 32 for example about 80% flows into the branch pipe. Of course instead of using a pure dimensioning of the branch pipe 34 in comparison with the foam producing branch 33 for achieving a greater throughput in the branch pipe 34, other means of providing the control member 15 may be provided if suitable dimensioning of the pipe cross-sections causes problems.

The air in the foam producing branch 33 arrives at a device 11 for producing cleaning foam built in the foam producing branch 33 as can be seen more closely in FIG. 6. The device 11 accordingly consists essentially of the flow constriction 9, preferably a Venturi nozzle, or the like, built into an insert member whereby preferably at the place of greatest cross-section constriction and thus the greatest static pressure drop an inlet mouth 10 of a pipe 16 for cleaning liquid from the supply container 17 is provided. Thereby in consequence of the accelerated flow from the flow constriction 9, cleaning liquid is drawn from the inlet mouth 10 is into the foam producing branch 33 and is foamed by the greatly accelerated air. In case of need there may be provided around the flow constriction 9, formed for example as a Venturi nozzle an annular chamber 16A in which cleaning liquid such as a soap solution flows in from the supply pipe 16 and from which several channels with inlet mouths 10 distributed preferably uniformly on the periphery in a manner not shown in detail lead into the foam producing branch 33 so that the foam is produced uniformly over the periphery of the foam producing branch 33.

Downstream of the device 11 for producing the cleaning foam there is provided in a manner known per se a porous member 12 for example made of permeable foam material or the like which serves the drying of the foam. The foam thus produced is fed, via the supply pipe 36 for the floor level deposit on of foam, to the foam delivery nozzle 37 and is distributed onto the carpet or the like, is worked in by the brush roller 3 and is drawn off again by the suction nozzle 7.

The excess air not required for producing foam or for let off into the branch pipe 34 may be let off into the surroundings. The energy of this compressed air may however be utilised with special advantage for purpose of driving the cleaning apparatus. This in the manner as can be seen from FIG. 4 the main drive of the brush roller may be derived from the electric motor 46 via a back gearing reduction gear 45 and the belt drive 46, and the excess air may be led directly onto the brush roller 3 for example in the manner as can be seen from FIG. 3. For this purpose the pipe 34 shown in FIG. 3 leads above the brush roller 3 into a compressed air nozzle 23 which guides the air onto the cover plate 23A.

The cover plate 23A is formed preferably arcuate in cross-section and is adapted to the periphery of the brush roller 3, and at the rear end in the direction of travel shown by arrow F it is partly fixed on the housing surrounding the brush roller 3. Thereby the compressed air from the compressed air nozzle 23 is guided tangentially to the surface of the brush roller 3 and due to a gap on the front end of the guide plate 23A is accelerated such that the air on the front side of the brush roller 3 in the direction of travel according to arrow F flows downwards along the periphery of the brush roller 3 and thereby exercises a driving force on the brush roller 3. This comparatively strong air flow from the top assists in particular the working of the foam delivered through the foam delivery nozzle 37 onto the carpet or the like so that the foam comes into contact even with the dirt located deeply in the carpet, is completely worked in by the brush and is partly lifted out again and is finally drawn off through the suction nozzle 7.

In a specially preferred manner however the excess air let off in the branch pipe 34 is made utilisable in a driving turbine 29 which acts on the brush roller 3 in the manner as can be seen from FIG. 5 via the belt drive 47. In such a turbine the energy of the excess air let off through the branch pipe 34 can be utilised with a particularly high degree of efficiency. The exhaust air of the driving turbine 29 can again be led to the brush roller 3 in the manner shown in FIG. 3 so that this remainder of the energy of the compressed air may still be used. Even when the apparatus is working in floor operation only slight pressure is necessary for the production of foam in the apparatus 11 so that the major part of the compressed air is diverted into the branch pipe 34 and can be made utilisable for the driving of the brush roller 3 for floor operation. If on the other hand in the manner to be described later, the apparatus is being worked with the additional apparatus 20, then for the production of foam and in particular for the transport of foam, substantially higher pressure is necessary so that the branch pipe can be completely closed. The whole supply from the suction blower 4 is reduced in order to make the flow losses occuring in the separator 26 utilisable for the conveying of the foam to the additional apparatus 20 whereby it has proved useful that with work with the additional apparatus 20 the driving of the brush roller 3 is neither necessary nor desirable. A suitable lowering of the pressure in the foam producing branch 33 possibly occurring for the consistency of the foam emerging at the additional apparatus 20 can then be achieved with completely closed branch pipe 34 in case of need by opening of the by-pass opening not shown.

For operation with the hand apparatus 20 the closures 13 are removed from the end 43 of the suction connection 39 and from the closable opening 35 of the foam producing branch 33 downstream of the apparatus 11 for the production of the cleaning foam and with closing of the suction pipe 40 and of the part of the main pipe 36 flowing downstream of the opening 35 the supply hose 41 and the suction hose 42 connect with the foam producing branch 33 and the suction connection piece 39 respectively.

In the lower part of the representation according to FIG. 6 there is illustrated downstream of the device 11 and of the porous body 12 the opening 35 for the connection of the feed hose 41 for the foam to the hand apparatus 20 provided with a closure 13 such as a closure cap or a closure stop. The connection of the supply hose 41 with its connection piece 14 is shown in FIG. 7. The front part of the connection 14 in the direction of the axis A—A of the connection piece is closed formed with an upper lateral inlet opening 14A substantially parallel to the axis A—A such that with the introduction of the connection piece 14 into the pipe 36 from the side, substantial sealing closure of the section of pipe 36 lying downstream of the closable opening 35 is effected and the foam can arrive via the opening 14A corresponding substantially to the inner cross section of the pipe 36 into the connection piece 14 and thus into the hose 41. In order to ensure that the opening 14A is aligned correctly upon sticking the connection piece 14 into the opening 35 the connection piece 14 and the opening 35 are provided with a guide device 14B in the example with a guide groove of the opening 35 and a guide projection of the connection piece 14. Upon changing over from floor operation to an operation with the additional apparatus 20 thus only the connection piece 14 need be inserted into the opening 35 of the pipe 36 in order on the one hand to close the area of the pipe 36 lying downstream against the entry of foam and on the other hand to ensure a secure conveying of the foam into the hose 41.

In FIG. 8 the corresponding connection of the suction hose 42 at the end 43 of the suction connection 39 is illustrated. The suction hose 42 also has a connection piece 21 which need only be inserted into the end 43 of the suction piece 39 in order to close the suction pipe 40 as well as also to connect the suction hose 42 at the same time. For this the end 43 of the suction piece 39 is constructed substantially rectilinearly and the suction pipe 40 in the area of the end 43 leads approximately at right angles to the suction connection piece 39. After removal of the closure 13 from the end 43 of the suction connection piece 39 the connection piece 21 of the suction hose 42 is stuck in so far that it covers the mouth of the suction pipe 40 with its outer periphery and is in communication itself with the inner space of the suction connection piece 39. In order to keep the suction hose 42 in this position a holder 22 illustrated diagrammatically is provided at the end 43 of the suction connection piece 39 which for example may comprise a resilient snap fastener which in the fully introduced position of the connection piece 21 engages behind a projection as a counter-holding part of the suction base 42 and thus secures the connection piece 21 in the end 43 in its position covering the mouth of the suction pipe 40. With this construction of the connection not only is a more simple changing over from floor operation to operation with the additional apparatus 20 and vice versa ensured but in addition also it is assured that in view of the higher flow resistance in the longer suction hose 42 a rectilinear suction flow low in resistance is ensured on connection of the suction hose 42 whilst the shorter suction pipe 40 results in a guiding around of the suction flow by 90°.

We claim:

1. A cleaning apparatus for universal application in the cleaning of carpets, carpet bases, upholstery and the like, comprising a blower, a compressed air main pipe for guiding air from said blower to a device for the production of cleaning foam, a suction pipe connected to said blower for suction air, a suction nozzle connected to said suction pipe for drawing off foam and dirt from the surface to be cleaned, a separator connected to said blower at a point between said suction nozzle and said device for the production of cleaning foam, said separator having at least one filter unit for the impurities carried along by the suction air, said compressed air main pipe having, upstream of said foam production device, a bleeding means for excess air and a control member for controlling the air throughput of said bleeding means, said compressed air main pipe having means for the application of cleaning foam onto the surface to be cleaned and a closable opening upstream of said application means and downstream of said foam production device for connection of a supply hose of an additional cleaning device, said device for the production of foam including a supply pipe connecting a cleaning liquid supply to said compressed air main pipe, said separator including an annular centrifuge chamber having a tangential air inlet, a dirt container disposed vertically below said centrifuge chamber, said dirt container having a foam removing agent with said filter unit disposed downstream of said dirt container with respect to the air flow, an additional cleaning device having a supply hose at one end of which is a connection piece for insertion into said closable opening in sealing contact with the periphery thereof and transverse to said compressed air main pipe, said connection piece having an inlet opening for receiving foam and lying generally parallel to the axis of said connection piece.

2. A cleaning apparatus according to claim 1, characterized in that said control member is formed by an adjustable throttle in a branch pipe forming said bleeding means.

3. A cleaning apparatus according to claim 1, characterized in that a suction hose for a manually operable suction head is connectible to the suction pipe of said suction blower.

4. A cleaning apparatus as claimed in claim 3 wherein said suction pipe extends to the floor level to define an effective suction zone, said suction pipe having a closable opening between said suction zone and said blower, said suction hose having a connection piece insertable into said closable opening so as to substantially seal off said suction pipe.

5. A cleaning apparatus according to claim 1, characterized in that said centrifuging chamber is communicated with said dirt container by a radially outward lying annular wide transfer opening.

6. A cleaning apparatus according to claim 5, characterized in that on the radial inner side of said transfer opening guide walls substantially covering the free cross-section of said transfer opening are provided having air passage openings to said filter unit lying thereabove.

7. A cleaning apparatus according to claim 1, characterized in that said filter unit has a cylindrical filter readily removable in upward direction, said cylindrical filter being surrounded by an annular supply space for air passing through said filter into said main pressure pipe.

8. The cleaning apparatus as claimed in claim 1 wherein said control member for controlling the air throughput of said bleeding means is adjustable between zero and 80% of the total compressed air throughput.

9. The cleaning apparatus as claimed in claim 1 wherein said compressed air main pipe has a branch pipe and a brush means is included in said apparatus with said branch pipe delivering air to means for driving said brush means.

10. The cleaning apparatus as claimed in claim 1 wherein said device for the production of cleaning foam is a Venturi nozzle and said supply pipe has an inlet opening in said Venturi nozzle.

11. A cleaning apparatus according to claim 10, characterized in that downstream of said inlet opening a porous body for the drying of the cleaning foam is provided.

* * * * *